US005864263A

United States Patent [19]

Takimoto et al.

[11] Patent Number: 5,864,263

[45] Date of Patent: Jan. 26, 1999

[54] DIELECTRIC FILTER WITH PROTECTIVE FILM COVERING THE EDGES OF THE INPUT/OUTPUT ELECTRODES AND EXTERNAL ELECTRODE

[75] Inventors: Nobuhiro Takimoto, Osaka; Tomoyuki Iwasaki, Kyoto, both of Japan

[73] Assignee: Matsushita Electric Industrial Co., Ltd., Osaka, Japan

[21] Appl. No.: 817,720

[22] PCT Filed: Jul. 29, 1996

[86] PCT No.: PCT/JP96/02127

§ 371 Date: Aug. 22, 1997

§ 102(e) Date: Aug. 22, 1997

[87] PCT Pub. No.: WO97/08773

PCT Pub. Date: Mar. 6, 1997

[30] Foreign Application Priority Data

Aug. 25, 1995 [JP] Japan ..... 7-217267

[51] Int. Cl.[6] ..... H01P 1/205; H01P 11/00

[52] U.S. Cl. ..... 333/202; 333/206

[58] Field of Search ..... 333/202, 204, 333/206, 207, 222

[56] References Cited

U.S. PATENT DOCUMENTS

| | | | |
|---|---|---|---|
| 5,122,768 | 6/1992 | Ito et al. | 333/204 |
| 5,288,351 | 2/1994 | Hoang et al. | 333/204 X |
| 5,365,208 | 11/1994 | Ito et al. | 333/204 |
| 5,374,910 | 12/1994 | Yamagata | 333/246 X |
| 5,495,215 | 2/1996 | Newell et al. | 333/206 X |
| 5,499,004 | 3/1996 | Noguchi et al. | 333/222 X |
| 5,517,162 | 5/1996 | Ariyoshi | 333/222 |

FOREIGN PATENT DOCUMENTS

| | | | |
|---|---|---|---|
| 60-183439 | 11/1985 | Japan . | |
| 63-181002 | 11/1988 | Japan . | |
| 1-227501 | 9/1989 | Japan . | |
| 4-103202 | 4/1992 | Japan . | |
| 4-198039 | 7/1992 | Japan . | |
| 6-276005 | 9/1994 | Japan | 333/206 |
| 6-318778 | 11/1994 | Japan . | |

*Primary Examiner*—Seungsook Ham
*Attorney, Agent, or Firm*—McDermott, Will & Emery

[57] ABSTRACT

The invention relates to a dielectric filter for mounting to a printed wiring board wherein the edges of the filter's electrodes are covered with a protective film to prevent the peeling of edges of electrodes. The dielectric filter is a dielectrics (1) having a through hole (2) extending from its top to bottom face, an external electrode (3*a*) disposed on the outer face of the dielectrics (1) except for the top face, an internal electrode (3*b*) disposed inside the through-hole (2), island-like input/output electrodes (6) which are disposed on the outer side face of said dielectrics (1) and surrounded by a non-electrode portion (5) of the external electrode (3*a*). An electrode protection film (8) covers an outer edge of said input/output electrode (6), the non-electrode portion (5) of the external electrode (3*a*) disposed around the input/output electrode (6), and an inner edge of the external electrode (3*a*) contacting the non-electrode portion (5).

16 Claims, 5 Drawing Sheets

DIELECTRIC FILTER WITH PROTECTIVE FILM COVERING THE EDGES OF THE INPUT/OUTPUT ELECTRODES AND EXTERNAL ELECTRODE

BACKGROUND OF THE INVENTION

The present invention relates to a dielectric filter used in communications equipment and a method of manufacturing the dielectric filter. Also, the present invention relates to a protection film for covering the edges of the filter's electrodes Conventionally, dielectric filters have an island-like input/output electrode, isolated from an external electrode, disposed on the outer side face of dielectrics having multiple through holes from the top to bottom.

One problem faced with a conventional dielectric filter is the peeling of the outer edge of the input/output electrodes and the inner edge of the external electrode of the dielectric filter, which may occur due to external stress, such as heat and twist applied to printed wiring boards when the dielectric filters are mounted to the printed wiring boards.

BRIEF SUMMARY OF THE INVENTION

The object of the present invention is to prevent the peeling of the edges of electrodes of a dielectric filter.

In order to achieve this object, the present invention relates to a dielectric filter comprising, dielectrics having a through hole extending from its top to bottom face, or non-through hole, an external electrode disposed on the outer face of the dielectrics except for the top face, an internal electrode disposed inside the through hole or non-through hole and island-like input/output electrodes, which are disposed on the outer side face of the dielectrics and surrounded by a non-electrode portion of the external electrode. An electrode protection film covers the outer edge of the input/output electrode, the non-electrode portion of the external electrode around the input/output electrode, and the inner edge of the external electrode contacting the non-electrode portion.

With the above structure, the present invention prevents the peeling of the outer edge of the input/output electrode and the inner edge of the outer electrode, which may occur due to external stress, such as when heat is applied thereto. The protective film covers the outer edge of the input/output electrodes and the inner edge of the outer electrode of the dielectric filter.

The invention itself, together with further objects and attendant advantages, will best be understood by reference to the following detailed description taken in conjunction with the accompanying figures.

DETAILED DESCRIPTION OF THE INVENTION

A preferred embodiment of a dielectric filter of the present invention is described below with reference to the drawings.

Figure 1:
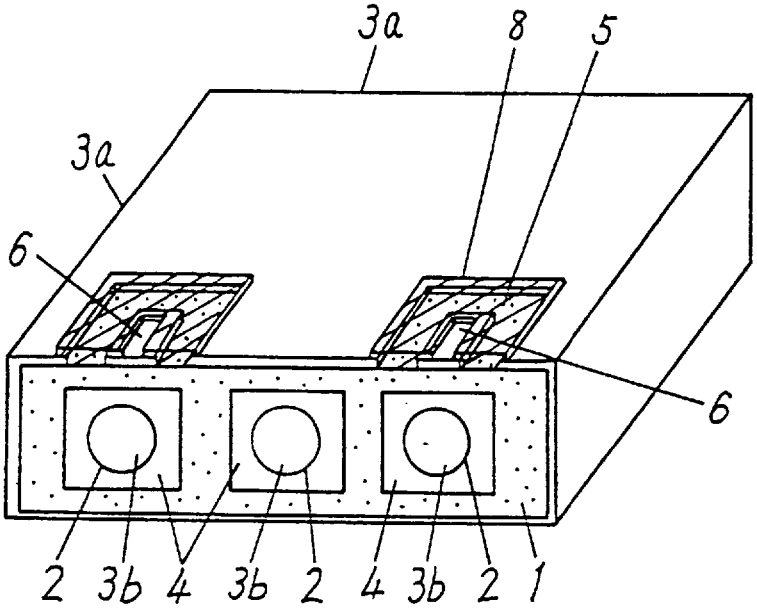
FIG. 1 is a perspective of a dielectric filter of a preferred embodiment of the present invention.

FIG. 1 is rectangular dielectrics, or dielectric material, 1 made of $BaTiO_3$-system ceramic. The dielectric material 1 has three cylindrical through holes, or non-through holes 2 extending from a top face (the open end) to a bottom face (the short-circuit end), an Ag-system external electrode 3*a* encasing the dielectrics on the outer side faces and bottom face of the dielectric material, an Ag-system internal electrode 3*b* on the internal face of each of the through holes 2, and capacity forming electrodes 4. Each capacity forming electrode 4 is connected to an internal electrode 3*b*, on the top face or open end.

A pair of C-shaped non-electrode portions 5 are disposed in a portion of external electrode 3*a* formed on an outer side face, at the open end, of the dielectric material 1. An island-like input/output electrode 6 is formed inside each of the C-shaped non-electrode portions 5, facing the through holes 2. An electrode protection film 8 is provided to cover the outer edge of the input/output electrode 6 and the inner edge of the cut-away portions of the external electrode 3*a* formed on the outer side face.

Figure 3:
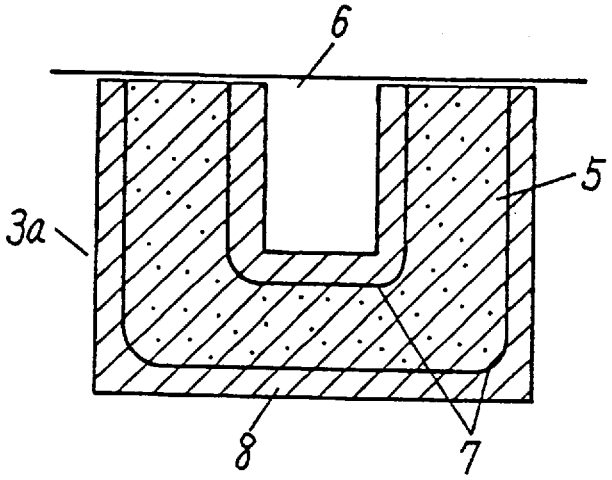
FIG. 3 is a plan view of an input/output electrode of the dielectric filter of FIG. 1.

FIG. 3 shows in greater detail how the corners 7 of the edge of the input/output electrode 6 and the edge of the external electrode 3*a* are curved to prevent a concentration of stress on the corners 7. The electrode protection film 8 is provided to cover the outer edge of the input/output electrode 6, the non-electrode portion 5, and the inner edge of the external electrode 3*a*. Thus, with the provision of the electrode protection film 8, the edges of the input/output electrode 6 and the external electrode 3*a*, which would otherwise be subject to peeling, can be protected.

The electrode protection film 8 is formed by applying a glass paste mixture of glass-ceramic and amorphous glass. One of the advantages of amorphous glass is its high strength. However, amorphous glass is likely to remelt under high temperature. This disadvantage of amorphous glass can be counteracted by fixing amorphous glass with glass-ceramic, which has good temperature characteristics.

Figure 2:
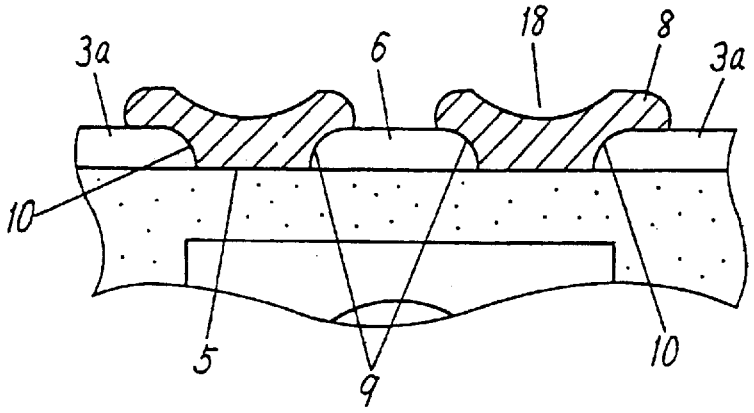
FIG. 2 is a sectional view of an input/output electrode of the dielectric filter of FIG. 1 depicting a state of application of an electrode protection film.

Furthermore, as shown in FIG. 2, the outer end face 9 of the input/output electrode 6 and the inner edges 10 of the external electrode 3*a* are curved. If the outer end face 9 and inner edges 10 were to have sharp edges, the electrode protection film 8 applied to such edges would become thinner and the effect of the electrode protection would be degraded. Edges of such end faces are rounded off to prevent a degrading in the effectiveness of the protective film 8.

A method of manufacturing the dielectric filter according to the present invention is described below.

First, in forming the external electrode 3*a* and the input/output electrodes 6, silver paste is applied to the dielectrics 1, on the face where the electrode protection film 8 will be formed, by means such as screen printing. The edges of the printed silver paste (the outer end face 9 and the inner edges 10) are sharp at this point. The silver paste is then heated up to approximately 850° C. to form the electrodes en the dielectrics 1. The silver paste melts and the edges of the electrodes become curved during the heat treatment. Then, after sintering, the finished end faces 9 and inner edges 10 become rounded, as shown in FIG. 2.

Next, glass paste is printed to cover the outer end face of the input/output electrode 6, the non-electrode portion 5, and the inner end face of the external electrode 3*a*. Printed glass paste is sintered under the same heating conditions as those for the silver paste described above.

During this process, the input/output electrode 6 and the external electrode 3*a* under the glass paste remelts. This allows the input/output electrode 6 and the external electrode 3*a* to mix with the glass paste. Consequently, the bonding strength between the input/output electrode 6 and the electrode protection film 8, and between the external electrode 3*a* and the electrode protection film 8, is strengthened.

Moreover, the silver paste contains a glass component for bonding the dielectric material 1 and the electrodes 6 and 3*a*. A part of the glass component, which is contained in the edges of the input/output electrodes 6 and external electrode 3*a*, combines with the glass paste during remelting, and further improves bonding strength.

Figure 4:
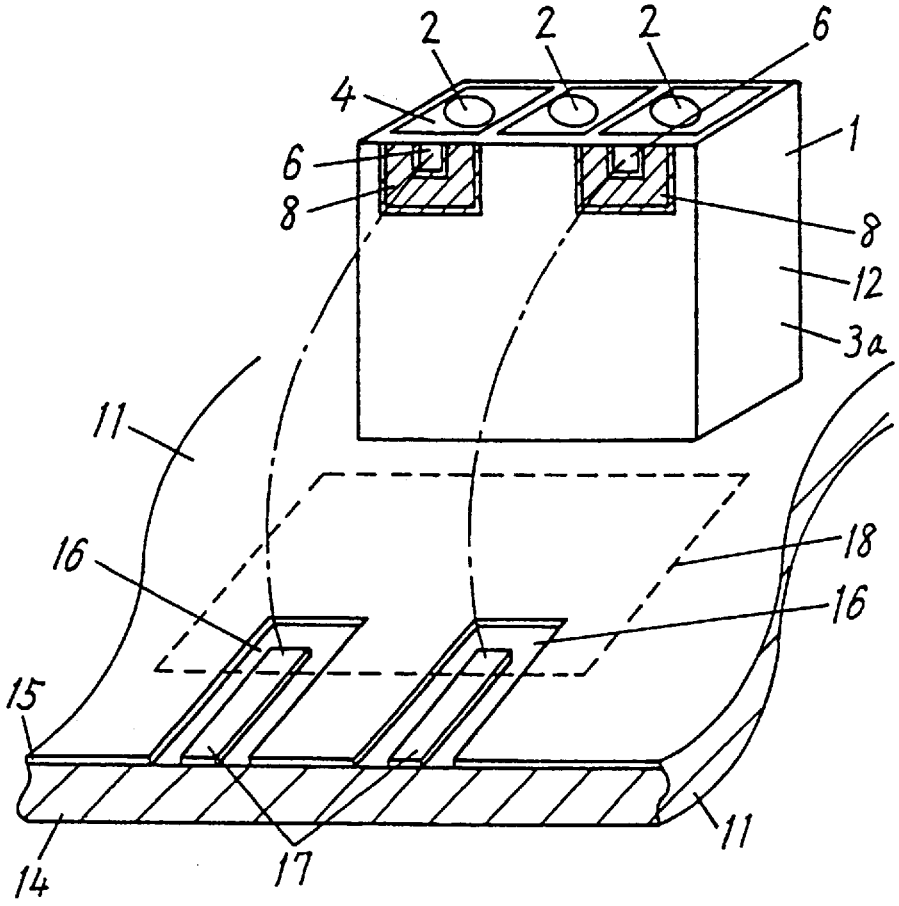
FIG. 4 is an exploded perspective view depicting the mounting of a preferred embodiment of a dielectric filter on a printed wiring board.
Figure 5:
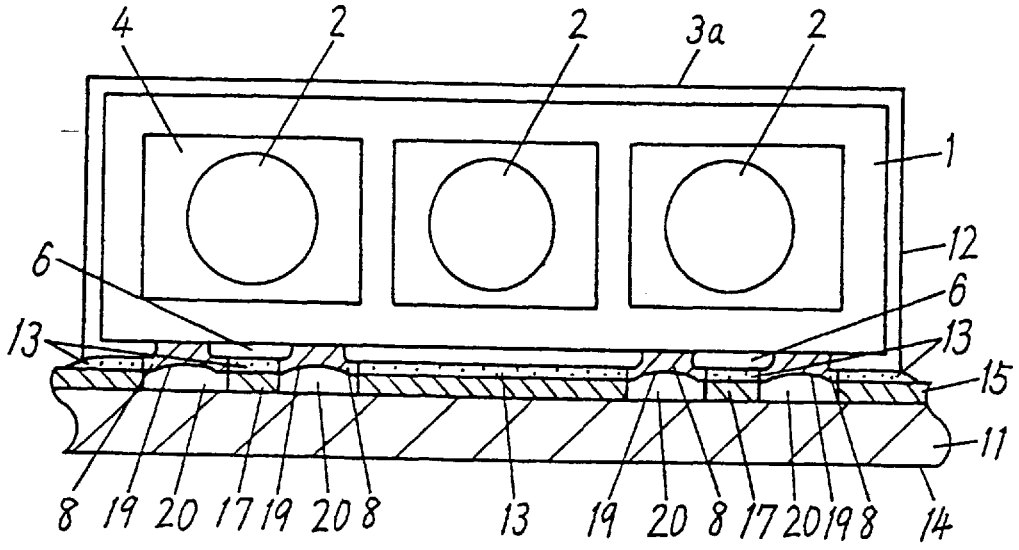
FIG. 5 is a front section view of the dielectric filter of FIG. 4 of the present invention mounted to a printed wiring board.

FIG. 4 and FIG. 5 illustrate a product of the present invention with the dielectric filter mounted on a printed wiring board 11. Conductive paste, such as solder paste 13, is applied to the area of the input/output electrodes 6 and external electrode 3*a*, and heated to permit the solder to flow. As a result, a product is formed wherein a dielectric filter 12 is mounted on a printed wiring board 11.

In particular, the printed wiring board 11 is formed by providing a copper electrode 15 on the surface of an epoxy substrate 14. Contact electrodes 17 are formed by a method such as etching the copper, thereby exposing non-conductive portions 16.

To form the product, solder paste 13 is applied to the contact electrodes 17 and a mounting area 18, which is the approximate size of the outer side face forming a portion of the external electrode 3*a*. Then, the dielectric filter 12 is placed over a portion of the contact electrodes 17 and the mounting area 18, and the input/output electrodes 6 are connected to the contact electrodes 17, respectively. Heat is applied to permit the solder to flow and bond the dielectric filter 12 to the printed wiring board 11.

FIG. 5 is an end view looking at the open face of the dielectric filter 12 and a cross-section of the printed wiring board 11. Depicted in FIG. 5, are the input/output electrodes 6 and the electrode protection film 8 of the dielectric filter 12. Also, FIG. 5 shows the contact electrodes 17 of the printed wiring board 11.

An area of the input/output electrodes 6 is larger than that of the contact electrodes 17. This is because, as mentioned previously, the electrode protection film 8 is formed on the outer edge of the input/output electrode 6. The area of an input/output electrode 6 is enlarged for the portion covered with the electrode protection film 8.

FIG. 5 also illustrates that the electrode protection film 8 covers both the outer edge of the input/output electrodes 6 and the inner edge of the external electrode 3*a*. Consequently, as also shown in FIG. 2, a dent 18 is formed between the input/output electrodes 6 and the external electrode 3*a*. This dent provides an intentional space 20 between the printed wiring board 11 and the electrode protection film 8 so as to prevent short-circuiting of an adjacent input/output electrode 6 with an external electrode 3*a* by spreading of the solder paste 13 between the printed wiring board 11 and electrode protection film 8 due to capillary action.

According to the present invention, the electrode protection film covering the outer edge of the input/output electrodes and the inner edge of the external electrode on an outer area of the dielectric filter prevents the peeling of the outer edge of the input/output electrode and inner edge of the external electrode, which peeling may otherwise occur due to external stress, such as heat.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A dielectric filter comprising:

a dielectric material having a top face, a bottom face and a plurality of side faces;

at least one through hole extending from the top face to the bottom face;

a internal electrode disposed inside each through hole;

an external electrode disposed on the bottom face and the plurality of side faces;

at least one island-like input/output electrode disposed on a side face of said dielectric material and surrounded by a non-electrode portion of the external electrode; and an electrode protection film covering an outer edge of each input/output electrode, the non-electrode portion of the external electrode disposed around the input/output electrode, and an inner edge of the external electrode adjacent the non-electrode portion, wherein said electrode protection film is dented over said non-electrode portion between the outer edge of the input/output electrode and the inner edge of the external electrode, and an outer end face of said input/output electrode and an inner end face of said external electrode disposed facing the outer end face of the input/output electrode are curved.

2. The dielectric filter of claim 1, wherein at least one corner of an outer periphery of the island-like input/output electrode and an inner periphery of the external electrode disposed on the outside of the input/output electrode are curved.

3. The dielectric filter of claim 1, wherein said electrode protection film is a glass paste mixture of at least glass-ceramic and amorphous glass.

4. The dielectric filter of claim 1, wherein said at least one through hole and said at least one island-like input/output electrode comprised of multiple through holes and multiple input/output electrodes, respectively, and are provided at specified intervals.

5. A dielectric filter comprising:

a dielectric material having a top face, a bottom face and a plurality of side faces, and having at least one non-through hole from the top face to the bottom face;

an internal electrode disposed inside each said non-through hole;

an external electrode disposed on the bottom face and the plurality of side faces;

at least one island-like input/output electrode disposed on a side face of said dielectric material and surrounded by a non-electrode portion of the external electrode; and an electrode protection film covering an outer edge of each input/output electrode, the non-electrode portion of the external electrode disposed around the input/output electrode, and an inner edge of the external electrode adjacent the non-electrode portion, wherein said electrode protection film is dented over said non-electrode portion between the outer edge of the input/output electrode and the inner edge of the external electrode, and an outer end face of said input/output electrode and an inner end face of said external electrode disposed facing the outer end face of the input/output electrode are curved.

6. A method of manufacturing of a dielectric filter comprising:

a dielectric material having a top face, a bottom face and a plurality of side faces, and having at least one non-through hole from the top face to the bottom face;

an external electrode disposed on the bottom face and the plurality of side faces;

an internal electrode disposed inside each said non-through hole;

at least one island-like input/output electrode disposed on a side face of said dielectric material and surrounded by a non-electrode portion of the external electrode; and an electrode protection film covering an outer edge of each input/output electrode, the non-electrode portion of the external electrode disposed around the input/output electrode, and an inner edge of the external electrode adjacent the non-electrode portion, wherein said electrode protection film is dented over said non-electrode portion between the outer edge of the input/output electrode and the inner edge of the external electrode, and an outer end face of said input/output electrode and an inner end face of said external electrode disposed facing the outer end face of the input/output electrode are curved, said method comprising the steps of:

applying a silver paste to a side face near the top face by means of screen printing to form each said island-like input/output electrode, said non-electrode portion of the external electrode and said inner edge of the external electrode in contact with the non-electrode portion; firing the silver paste to curve the edges of the electrodes at a predetermined temperature;

applying a glass paste to said outer edge of said each island-like input/output electrode, and said non-electrode portion of the external electrode and said inner edge of the external electrode adjacent the non-electrode portion; and then firing the glass paste at approximately said predetermined temperature as that for the electrodes, so as to provide said electrode protection film over the outer edge of said input/output electrode, the non-electrode portion of the external electrode, and the inner edge of the external electrode adjacent the non-electrode portion.

7. A combination of a dielectric filter mounted to a printed wiring board, said combination comprising:

a printed wiring board; and a dielectric filter mounted on a surface of the printed wiring board, wherein the dielectric filter includes, a dielectric material having a top face, a bottom face and a plurality of side faces, and having at least one non-through hole from the top face to the bottom face;

an internal electrode disposed inside each said non-through hole;

an external electrode disposed on the bottom face and the plurality of side faces;

at least one island-like input/output electrode disposed on a side face of said dielectric material and surrounded by a non-electrode portion of the external electrode; and an electrode protection film covering an outer edge of each input/output electrode, the non-electrode portion of the external electrode disposed around the input/output electrode, and an inner edge of the external electrode adjacent the non-electrode portion, wherein an outer end face of said input/output electrode and an inner end face of said external electrode disposed facing the outer end face of the input/output electrode are curved, and wherein the printed wiring board includes, a surface provided with at least one contact electrode connected with said at least one input/output electrode of said dielectric filter, and another electrode connected with the external electrode of said dielectric filter, an area of each input/output electrode of the dielectric filter being larger than that of a corresponding contact electrode.

8. The combination of claim 7, wherein at least one corner of an outer periphery of the island-like input/output electrode and an inner periphery of the external electrode disposed on the outside of the input/output electrode are curved.

9. The combination of claim 7, wherein said electrode protection film is a glass paste mixture of at least glass-ceramic and amorphous glass.

10. The combination of claim 7, wherein said at least one non-through hole and said at least one island-like input/output electrode comprised of multiple non-through holes, and multiple input/output electrodes, respectively, and are provided at specified intervals.

11. The combination of claim 7, wherein said electrode protection film is dented over said non-electrode portion between the outer edge of the input/output electrode and the inner edge of the external electrode.

12. A dielectric device comprising:

a dielectric material having a top face, a bottom face and a plurality of side faces;

an external electrode disposed on the bottom face and the plurality of side faces;

at least one island-like input/output electrode disposed on a side face of said dielectric material and surrounded by a non-electrode portion of the external electrode; and an electrode protection film covering an outer edge of each input/output electrode, the non-electrode portion of the external electrode disposed around the input/output electrode, and an inner edge of the external electrode adjacent the non-electrode portion, wherein said electrode protection film is dented over said non-electrode portion between the outer edge of the input/output electrode and the inner edge of the external electrode, and an outer end face of said input/output electrode and an inner end face of said external electrode disposed facing the outer end face of the input/output electrode are curved.

13. The dielectric device of claim 12, wherein said electrode protection film is a glass paste mixture of at least glass-ceramic and amorphous glass.

14. The dielectric device of claim 12, wherein said electrode protection film is dented over said non-electrode portion between the outer edge of the input/output electrode and the inner edge of the external electrode.

15. The dielectric device of claim 14, wherein said electrode protection film is a glass paste mixture of at least glass-ceramic and amorphous glass.

16. The dielectric device of claim 14, further comprising multiple through holes and multiple input/output electrodes are provided on said dielectric material at specified intervals.

* * * * *